US009277768B2

(12) United States Patent
Xiu

(10) Patent No.: US 9,277,768 B2
(45) Date of Patent: Mar. 8, 2016

(54) ELECTRONIC SIMULATED CIGARETTE AND ATOMIZING LIQUID THEREOF, SMOKING SET FOR ELECTRONIC SIMULATED CIGARETTE AND SMOKING LIQUID CAPSULE THEREOF

(76) Inventor: Yunqiang Xiu, West Yorkshire (GB)

( * ) Notice: Subject to any disclaimer, the term of this patent is extended or adjusted under 35 U.S.C. 154(b) by 1124 days.

(21) Appl. No.: 12/744,630

(22) PCT Filed: Mar. 31, 2008

(86) PCT No.: PCT/CN2008/000645
§ 371 (c)(1),
(2), (4) Date: Sep. 28, 2010

(87) PCT Pub. No.: WO2009/105919
PCT Pub. Date: Sep. 3, 2009

(65) Prior Publication Data

US 2011/0005535 A1 Jan. 13, 2011

(30) Foreign Application Priority Data

Feb. 29, 2008 (CN) ..... 2008 1 0014682
Mar. 20, 2008 (CN) ..... 2008 1 0014836

(51) Int. Cl.
*A24F 47/00* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS

| | | | | |
|---|---|---|---|---|
| 4,083,372 | A | 4/1978 | Boden | |
| 4,945,931 | A | 8/1990 | Gori | |
| 2003/0150454 | A1 | 8/2003 | Burr et al. | |
| 2006/0196518 | A1 * | 9/2006 | Hon | 131/360 |
| 2007/0267031 | A1 * | 11/2007 | Hon | 131/273 |

FOREIGN PATENT DOCUMENTS

| | | |
|---|---|---|
| CN | 1135860 | 11/1996 |
| CN | 1530041 | 9/2004 |
| CN | 1541577 | 11/2004 |
| CN | 2719043 | 8/2005 |
| CN | 1772072 | 5/2006 |
| CN | 2777995 | 5/2006 |
| CN | 101084801 | 12/2007 |
| CN | 200983833 | 12/2007 |
| CN | 201029436 | 3/2008 |
| GB | 2415597 | 1/2006 |

OTHER PUBLICATIONS

International Search Report, PCT Application No. PCT/CN2008/000645, PCT filing date Mar. 31, 2008.

* cited by examiner

*Primary Examiner* — Richard Crispino
*Assistant Examiner* — Phu Nguyen
(74) *Attorney, Agent, or Firm* — Han IP Corporation

(57) ABSTRACT

An electronic simulation cigarette comprises a shell. One end of the shell installs the air inlet port while in the shell the power source, atomization and spray device, capsule with smoke solution in it are set up. Connect the power source and the heater, the capsule and the atomization and spray device. Install the capsule aspiration device at one end of the atomization and spray device and penetrate the device in the capsule. Spraying solutions used for the electronic simulation cigarette include the polyethylene glycol, the propylene glycol and the taste modifier. A smoking set of the electronic simulation cigarette includes the suction nozzle which is linked with the shell of the smoking set.

4 Claims, 6 Drawing Sheets

ELECTRONIC SIMULATED CIGARETTE AND ATOMIZING LIQUID THEREOF, SMOKING SET FOR ELECTRONIC SIMULATED CIGARETTE AND SMOKING LIQUID CAPSULE THEREOF

The present invention relates to the electronic cigarette which is the electronic simulation cigarette with its atomizing e-liquid and the smoking set of the electronic simulation cigarette and its smoke solution capsule (liquid container).

All kinds of cigarettes contain harmful substances at present and it is recognized by the world that the harmful substances will do harm to our human body. Thus, the irritation of the flavour from the cigarette is one reason for the smoker to give up smoking. For this reason, the applicant invents the electronic simulated cigarette and atomizing liquid. This will help smoker easily to quit smoking or alternative to traditional cigarette.

The electronic simulation cigarette designed by the applicant has more advantages. It can really replace the cigarette because both of its flavour and taste can compare favourably with tobacco cigarettes. The smoke solution can be long-term conserved; therefore smokers can buy and enjoy the cigarette at any time according to the demands of themselves. This kind of electronic simulation cigarette consists of at least two parts: one part is the device which can atomize the smoke solution; the other part is the smoking set with smoke solution and suction nozzle. Therein, the atomization and spray device has many characters such as long service life, no need of replacement frequently and relatively high cost of construction. Moreover, the smoking set and the smoke solution capsule can be changed at all times according to the smokers' demands. All these actual existed problems are the main design philosophies of the program which is about the smoking set of the electronic simulation cigarette and its smoke solution capsule applied by the applicant.

The first purpose of the present invention is to provide a kind of the electronic simulation cigarette and its atomizing e-liquid. It is able to make the aroma, taste and flavour of the electronic simulation cigarette quite identical to that of the tobacco cigarettes'. Furthermore, it can be long-term conserved, the smoke solution is non-volatilized, and achieve a better level of guaranteeing of the smoke solution's quality and freshness in the prolonged storage period.

The second purpose of the present invention is to provide a smoking set of the electronic simulation cigarette. The smoking set is made to be a single product which can be co-used with the atomization and spray device of the electronic simulation cigarette to constitute the electronic simulation cigarette so as to satisfy the various demands of different smokers and at the same time reduce the cost of the customers when purchasing the electronic simulation cigarette. The third purpose of the present invention is to provide a kind of smoke solution capsule which can be co-used with the smoking set of the electronic simulation cigarette. It can be sold as a single product. Install it on the smoking set said above in the present invention, and then the customers can purchase different smoke solution capsules according to their different demands at any time to feel the requirements of various flavours and different tastes.

In order to realize the purposes said above in the present invention, the following technical programs are put into effort. An electronic simulation cigarette consists of the shell. One end of the shell installs the air inlet port while in the shell the power source, atomization and spray device, capsule with smoke solution in it are set up. Connect the power source and the heater, the capsule and the atomization and spray device.

Install the capsule aspiration device at one end of the atomization and spray device and penetrate the device in the capsule.

The further scheme of the present invention is: set up the liquid resistance plate, the liquid storage chamber, the atomizing chamber and the supporting base. Install the heater in the atomizing chamber and open jet orifices on the supporting base. The aspiration device consists of aspiration needle tube in which installs the stylet. The liquid storage chamber is filled with infillings which is siphoning material. Then, the liquid storage chamber is linked to the fluid guide rack while it is connected with the aspiration needle tube and set up vent hole on the liquid resistance plate. Install the filter tip fixation on one end of the shell, install joint lever on the filter tip fixation through which the filter tip fixation and the filter tip connects. Set up the through hole at the middle of the joint lever and set up the cavity on the filter tip fixation and then connect the through hole and the cavity. Install the capsule fixation at the peripheral region of the capsule and set up air passage on the outer end wall of the capsule fixation. Install the switch-return spring, the pneumatic transmission switch and the pneumatic transmission switch contactor in the shell. The pneumatic transmission switch contactor is linked to the support while the support links to the heater via the junction block.

The atomizing e-liquid used in the electronic simulation cigarette in the present invention said above consists of the following raw materials measure by amount by weight: the polyethylene glycol 25-90 weight share, the propylene glycol 9-50 weight share, Glycerine 1-70 weight share, water 1-30 weight share and the taste modifier 0.3-52 weight share. The said taste modifier's weight share raw material is constituted by one or more than two raw materials that followed: 2-acetylpyrazine, vanillin, 2,3,5-trimethylprazine, methyl cyclopentenolone, linalool, extracts of *Vanilla planifolia*, caprylolactone, Bulgarian Rose Otto, megastigmatrienone (Baosha aromatic tobacco essential oil), damascenone, purified water, menthol, fire-cured tobacco essential oil, fire-cured tobacco absolute oil, burley tobacco absolute oil, Turkey aromatic tobacco absolute oil and glycerin.

The atomizing e-liquid used in the electronic simulation cigarette in the present invention said above has extra health materials which measure by amount by weight: green tea extract 2-10 weight share, caffeine 2-10 weight share, extracts of wolfberry 3-20 weight share or Viagra virility medication 1-5 weight share.

The atomizing e-liquid used in the electronic simulation cigarette in the present invention said above has extra raw material of nicotine which measures by amount by weight: 0.5-18 weight share.

The atomizing e-liquid used in the electronic simulation cigarette in the present invention said above has extra raw material of purified water which measures by amount by weight: 0.5-10 weight share.

In order to realize the second purpose of the present invention, the following technical programs are put into effort. A smoking set of the electronic simulation cigarette includes the suction nozzle which is linked with the shell of the smoking set. Set up inner cavity on the shell of the smoking set. One end of the smoking set is set up the pinhole while the other end is the open type. Set up the connection unit which is connected with the atomization and spray device on the inner wall or the outer wall of one end of the shell of the smoking set.

The present invention is going to better realize the second purpose of the invention; it could be realized through the following technical programs: install the smoke solution capsule (liquid container) in the cavity and fill the cavity of the smoke solution capsule with smoke solution while the smoke solution capsule is enclosed. Set up the fixation at the connecting pin of the shell of the smoking set and the suction nozzle while it is connects with the suction nozzle and set up vent hole on it. Set up orifice plate on the fixation and open vent port on the orifice plate. Set up both the smoke solution backflow cavity and the joint lever on the fixation and open vent hole on the joint lever. One end of the joint lever links to the suction nozzle while the other end inserts into the central section of the smoke solution backflow cavity. Install the absorption pad at the inner wall of the smoke solution backflow cavity and the connecting pin of the joint lever. Set up suction hole at one end of the suction nozzle, open the smoke solution backflow cavity on the suction nozzle and install air suction pipe in the smoke solution backflow cavity and finally communicate the air suction pipe and the suction hole. Under interference fit of the outer wall of the air suction pipe and the suction nozzle, orifice plate should be installed in the suction nozzle and open through hole on the orifice plate. Install absorption pad at the joint of the smoke solution backflow cavity and the air suction pipe.

The technical program applied for the realization of the third purpose in the present invention is the smoke solution capsule which is co-used with the smoking set of the electronic simulation cigarette. Its shell is made by soft capsule or plastic container material which is for medical use. The shape of the shell could be any regular or irregular geometry with smoke solution in the shell. A further optimum scheme is to design the shape of the shell into an oval. The smoke solution in the shell is the mixture of the polyethylene glycol, the propylene glycol, Glycerine, water and the taste modifier.

The electronic simulation cigarette said in of the present invention can long-term conserve the atomizing e-liquid. Furthermore, in the retention period the quality and the flavour can remain unchanged. The problem of unable to form end product for the reason of incapable conservation of the smoke solution of the electronic simulation cigarette is completely resolved. So, the electronic simulation cigarette can truly replace the tobacco cigarette. Consequently, the harmful substances in the tobacco cigarette will do less harm to human beings.

The spraying performance of the atomizing e-liquid which is used in the electronic cigarette in the present invention is quite good. The atomizing e-liquid can be atomized at once when comes across heat. After probation the smokers are satisfied with the taste and the flavour of the electronic cigarette. The compositions of the smoke solution are all no harmful materials and health care compositions can be added according to the demands. And the smoke solution can be made into various flavour types or different types of cigarette according to the demands. The atomizing e-liquid enables good stability of the capsule, thus provides better conditions for the long-term conservation of the smoke solution.

The smoking set of the electronic simulation cigarette and its smoke solution capsule (liquid container) said in the present invention provide two products. One is the smoking set of the electronic simulation cigarette which is co-used with the atomization and spray device of the electronic simulation cigarette. Therefore, this can resolve the problem of high cost when the customers purchase the product while the atomization and spray device of the electronic simulation cigarette and the smoking set are sold as a product. The smoking set in the present invention can reduce the usage cost of the customers and can at the same time satisfy the customers to buy different kinds of smoking set according to their demands at any time. So, the smoking sets can be made into different costs and various specifications. For example, the said suction nozzle could be ordinary filter tip, refined filter tip, plasticity material suction nozzle and so on. The second product is the smoke solution capsule (liquid container). In order to further reduce the spent cost, the smoke solution capsule is made into a product. The smoke solution is filled in the smoke solution capsule (liquid container). The smoke solution has various types of flavours and tastes and can be smoked completely via atomization in a very short time. As a result, a smoking set can be used with various smoke solution capsules (liquid container). Sold the smoke solution capsule (liquid container) separately can not only reduce the spent cost but also can satisfy the customers to buy different smoke solution capsules with various tastes and flavours and at the same time it is more easy for storage and usage.

Embodiments of the present invention will now be described, by way of example only and with reference to the accompanying drawings of which:

A further explanation of the electronic simulation cigarette in the present invention is given while comparing with the figures.

Figure 1:
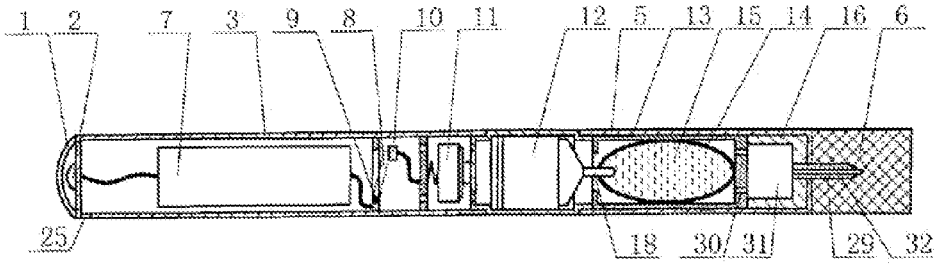
FIG. 1 is the structure diagram of the electronic simulation cigarette with its own filter tip in the present invention.
Figure 2:
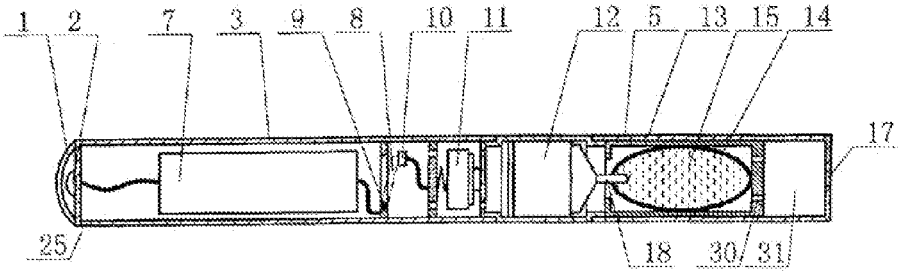
FIG. 2 is the structure diagram of the electronic simulation cigarette with no filter tip in the present invention.
Figure 3:
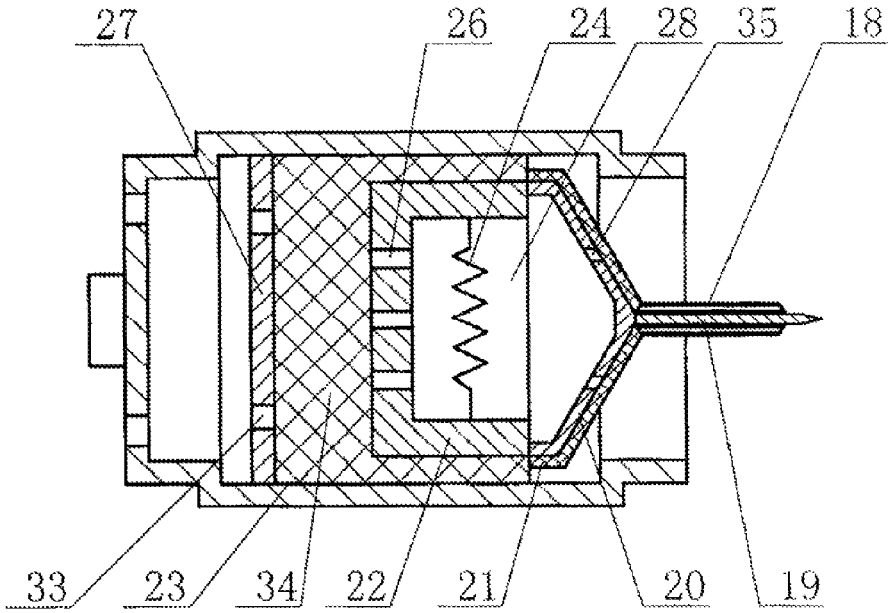
FIG. 3 is the enlarged structure diagram of liquid atomization and spray device 12 in FIG. 1 and FIG. 2.

In FIG. 1 to FIG. 3, set up air inlet port 25 at one end of the shell 3, install power source 7 and atomization and spray device 12 in shell 3 and install heater 24 in the atomization and spray device 12 and then connect power source 7, heater 24 and the indicator light 2 at the same time. Install capsule (liquid container) 14 in shell 3 and capsule (liquid container) 14 is enclosed when producing. Capsule (liquid container) 14 is produced by the soft capsule or plastic container material which is for medical usage. In capsule (liquid container) 14 there is the smoke solution which is the atomizing e-liquid said above in the present invention. Capsule (liquid container) 14 and atomization and spray device 12 are linked together. Install capsule aspiration device at one end of atomization and spray device 12 and the capsule aspiration device is penetrated into capsule (liquid container) 14.

The preferred embodiment for spray device 12 as described in this invention is stated as follows: spray device 12 is equipped with liquid resistance plate 27, liquid storage chamber 23, atomizing chamber 28 and supporting base 22; atomizing chamber 28 is installed with heater 24; jet hole 26 is made on the supporting base 22; penetration device is equipped with penetration needle tube 18; siphoning material 19 and 21 is installed inside the aspiration needle tube 18 and fluid guide rack 20; of course, another embodiment is also available-only on condition that the end of penetration device can penetrate through the fluid guide tube of capsule 14; such embodiment is characterized by simple processing, which can substitute needle tube and needle core structure; however, fluid guide tube must be made of material of adequate rigidity. Liquid storage chamber 23 as described in this invention is filled with infilling 34 which can be either sponge or various fluid absorbing materials. Liquid storage chamber 23 is connected with fluid guide rack 20; whereas fluid guide rack 20 is connected with aspiration needle tube 18; vent pipe 33 is perforated on the liquid resistance plate 27. Smoke fluid is delivered to the infilling 34 via the passage on the aspiration needle tube 18 and fluid guide rack 20; liquid resistance plate 27 is used to prevent outflow of smoke fluid. Such structure can bring perfect fibrillating sense to smokers. Of course, smoke fluid as contained in capsule (liquid container) 14 can also be directly delivered to the atomizing chamber 28, and thus omit such structures as fluid guide rack. However, such embodiment is unlikely to bring fibrillating and soft sense to smokers.

Figure 5:
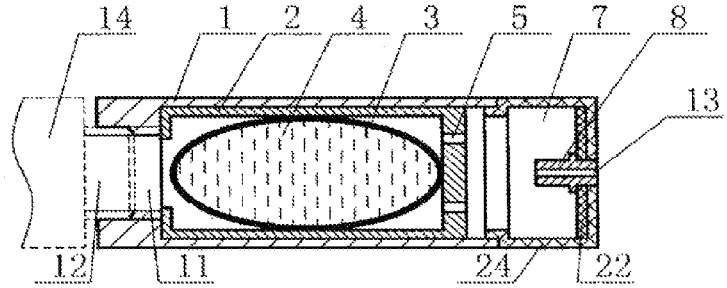
FIG. 5 is the structure diagram of the second embodiment of the smoking set of the electronic simulation cigarette in the present invention.

The electronic simulation cigarette, of the present invention can be fitted with various filter tips. It is also can be used without filter tips as shown in FIG. 2 and FIG. 5. The optimum scheme of installing the filter tip in the present invention is: install the filter tip fixation 16 on one end of shell 3 and install joint lever 29 on filter tip fixation 16, then connect filter tip fixation 16 and filter tip 6 through joint lever 29. Set up through hole 32 at the middle of joint lever 29, open cavity 31 on the filter tip fixation 16 and finally connect through hole 32 and cavity 31. The other program is to make the filter tip fixation 16 and the filter tip 6 as a whole, the joint lever 29 is cut out for this reason.

In order to further fix capsule (liquid container) 14 in the present invention, capsule fixation 13 can be installed at the peripheral region of capsule (liquid container) 14 while air passage 30 is set up at the outer end wall of capsule fixation 13.

The power disconnection switch of the electronic simulation cigarette in the present invention can be both installed at the outside or the inside of shell 3 while the structure of the switch can be realized by the widely-known technology. An optimum scheme is provided in the present invention which is much trustworthy with good security and long service life than the program that carried out by the widely-known technology. The specific structure is to install switch-return spring 9, pneumatic transmission switch 8 and pneumatic transmission switch contactor 10 in shell 3. Pneumatic transmission switch contactor 10 is linked to support 11 while support 11 is linked to heater 24 through the junction block.

When the electronic simulation cigarette said in the present invention is used, the air is inhaled through air-inlet port 25 while the smoker smoking. Then, pneumatic transmission switch 8 is pushed to the condition of opening. This moment pneumatic transmission switch 8 come into contact with pneumatic transmission switch contactor 10, after this indicator light 2 is on and heater 24 is connected. At the same time, the air enters liquid atomization and spray device 12, the smoke solution enters heater 24 via jet hole 26. The smoke solution atomized at once when it is heated. So, the smoke is inhaled into the mouth whether it through the filter tip or not.

Shell 3 said in the present invention can be divided into several sections. Capsule (liquid container) 14 and the filter tip (or the suction nozzle) or the suction pipe is one section. This section is the article of consumption and can be changed at any time. The power source, the heater and the switch block is another section. Certainly the power source and the heater can be regarded as separate sections. The connection of multi-section shell 3 can be realized by any connection type of the widely-known technology.

The atomizing e-liquid used in the electronic simulation cigarette in the present invention said above consists of the following raw materials measure by amount by weight: the polyethylene glycol 25-90 weight share, the propylene glycol 9-50 weight share, Glycerine 1-70 weight share, water 1-30 weight share and the taste modifier 0.3-52 weight share. Therein the polyethylene glycol is mainly used to keep the stability of the substances at the perisporium of the capsule and to prevent the occurrences of solution, transformation or leakage of capsule 14 when the smoke solution is long-term conserved. In addition, it has partial actions of atomizing. The propylene glycol and glycerine are mainly used to add the amount of the smoke. And increase the speed of the solution when nicotine and taste modifier are used in the atomizing e-liquid. The taste modifier said in the present invention can be constituted by one or more than two types according to the demands.

The specific embodiments are as follows:

1. The polyethylene glycol 90 weight share, the propylene glycol 9.7 weight share and vanillin 0.3 weight share.
2. The polyethylene glycol 74.2 weight share, the propylene glycol 25 weight share, vanillin 0.3 weight share and 2-acetylpyrazine 0.5 weight share.
3. The polyethylene glycol 69.7 weight share, the propylene glycol 20 weight share, vanillin 0.3 weight share, linalool 6 weight share and menthol 4 weight share.
4. The polyethylene glycol 70 weight share, the propylene glycol 20 weight share, glycerin 3 weight share, nicotine 0.5 weight share, damascenone 2 weight share, fire-cured tobacco absolute oil 5 weight share and burley tobacco absolute oil 5 weight share.
5. The polyethylene glycol 29.2 weight share, the propylene glycol 50 weight share, nicotine 10 weight share, purified water 0.5 weight share, 2-acetylpyrazine 0.5 weight share, vanillin 0.3 weight share, caprylolactone 2 weight share, Bulgarian Rose Otto 2.5 weight share and Viagra virility medication 5 weight share.
6. The polyethylene glycol 27.7 weight share, the propylene glycol 42 weight share, nicotine 10 weight share, purified water 5 weight share, 2-acetylpyrazine 0.5 weight share, vanillin 0.3 weight share, caprylolactone 2 weight share, Bulgarian Rose Otto 2.5 weight share and green tea extract 10 weight share.
7. The polyethylene glycol 25 weight share, the propylene glycol 50 weight share, nicotine 10 weight share, purified water 7.7 weight share, 2-acetylpyrazine 0.5 weight share, vanillin 0.3 weight share, caprylolactone 2 weight share, Bulgarian Rose Otto 2.5 weight share and caffeine 2 weight share.
8. The polyethylene glycol 25 weight share, the propylene glycol 40 weight share, nicotine 10 weight share, purified water 10 weight share, 2-acetylpyrazine 0.5 weight share, vanillin 0.3 weight share, caprylolactone 2 weight share, Bulgarian Rose Otto 2.2 weight share and wolfberry extract 10 weight share.

9. The polyethylene glycol 48.7 weight share, the propylene glycol 30 weight share, nicotine 10 weight share, purified water 5 weight share, 2-acetylpyrazine 0.5 weight share, vanillin 0.3 weight share, caprylolactone 2 weight share, Bulgarian Rose Otto 2.5 weight share and Viagra virility medication 1 weight share.

10. The polyethylene glycol 25 weight share, the propylene glycol 9 weight share, nicotine 18 weight share, purified water 8 weight share, 2-acetylpyrazine 0.5 weight share, vanillin 0.3 weight share, 2,3,5-trimethylprazine 0.5 weight share, methyl cyclopentenolone 1.5 weight share, linalool 6 weight share, extracts of *Vanilla planifolia* 5 weight share, caprylolactone 2 weight share, Bulgarian Rose Otto 2.5 weight share, megastigmatrienone 3 weight share, damascenone 3 weight share, menthol 4 weight share, fire-cured tobacco essential oil 2 weight share, fire-cured tobacco absolute oil 2 weight share, burley tobacco absolute oil 2 weight share, Turkey aromatic tobacco absolute oil 2 weight share and glycerin 3.7 weight share.

11. The polyethylene glycol 25 weight share, the propylene glycol 9 weight share, nicotine 18 weight share, purified water 8 weight share, 2-acetylpyrazine 0.5 weight share, vanillin 0.3 weight share, 2,3,5-trimethylprazine 0.5 weight share, methyl cyclopentenolone 1.5 weight share, linalool 6 weight share, extracts of *Vanilla planifolia* 5 weight share, caprylolactone 2 weight share, Bulgarian Rose Otto 2.5 weight share, megastigmatrienone 3 weight share, damascenone 3 weight share, menthol 4 weight share, fire-cured tobacco essential oil 2 weight share, fire-cured tobacco absolute oil 2 weight share, burley tobacco absolute oil 2 weight share, Turkey aromatic tobacco absolute oil 2 weight share, glycerin 1.7 weight share and green tea extract 2 weight share.

12. The polyethylene glycol 25 weight share, the propylene glycol 9 weight share, nicotine 18 weight share, purified water 8 weight share, 2-acetylpyrazine 0.5 weight share, vanillin 0.3 weight share, 2,3,5-trimethylprazine 0.5 weight share, methyl cyclopentenolone 1.5 weight share, linalool 6 weight share, extracts of *Vanilla planifolia* 5 weight share, caprylolactone 2 weight share, Bulgarian Rose Otto 2.5 weight share, megastigmatrienone 3 weight share, damascenone 3 weight share, menthol 4 weight share, fire-cured tobacco essential oil 2 weight share, fire-cured tobacco absolute oil 2 weight share, burley tobacco absolute oil 2 weight share, Turkey aromatic tobacco absolute oil 1.5 weight share, glycerin 1.2 weight share and wolfberry extract 3 weight share.

13. The polyethylene glycol 25 weight share, the propylene glycol 15 weight share, purified water 8 weight share, megastigmatrienone 8 weight share, extracts of *Vanilla planifolia* 6 weight share, damascenone 8 weight share, fire-cured tobacco essential oil 5 weight share, menthol 4 weight share, Turkey aromatic tobacco absolute oil 5 weight share, glycerin 9 weight share, caprylolactone 2 weight share and burley tobacco absolute oil 5 weight share.

14. The polyethylene glycol 25 weight share, the propylene glycol 15 weight share, purified water 8 weight share, megastigmatrienone 8 weight share, extracts of *Vanilla planifolia* 6 weight share, damascenone 8 weight share, menthol 4 weight share, glycerin 4 weight share, caprylolactone 2 weight share and wolfberry extract 20 weight share.

15. The polyethylene glycol 25 weight share, the propylene glycol 15 weight share, purified water 8 weight share, megastigmatrienone 8 weight share, fire-cured tobacco essential oil 5 weight share, menthol 4 weight share, glycerin 9 weight share, caprylolactone 2 weight share and caffeine 10 weight share.

In FIG. 1, FIG. 2 and FIG. 3, 1 is the cover of the indicator light, 5 is the shell of the capsule fixation, 15 is the smoke solution, 17 is the suction nozzle, 21 is the fluid guide rack and 35 is the hole.

Figures on the smoking set of electronic simulation cigarette and the smoke solution capsule said in the present invention are from FIG. 4 to FIG. 12. Sequence numbers of the parts in the figures are from 1 to 25.

Comparing with FIG. 4 to FIG. 12, a further specification is given on the smoking set of the electronic simulation cigarette and its smoke solution capsule.

The smoking set of the electronic simulation cigarette of the present invention can be manufactured as a product. Its structure consists of suction nozzle 10 which is linked to shell 1 of the smoking set. In shell 1 of the smoking set, cavity 23 is set up. The other end of the shell 1 of the smoking set is of open type which is convenient for the lay up of the smoke solution capsule. Set up the connection unit which is connected with the atomization and spray device on the inner wall or the outer wall of one end of shell 1 of the smoking set.

The further program on the product of the present invention is to install smoke solution capsule 3 in cavity 23 and fill the cavity of smoke solution capsule 3 with smoke solution 4. In addition, smoke solution capsule 3 is a sealed type.

There are a number of different structures capable of having a connection between the smoking set and a suction nozzle 10 (FIG. 4), or a suction pipe 24 (FIG. 5).

Figure 4:
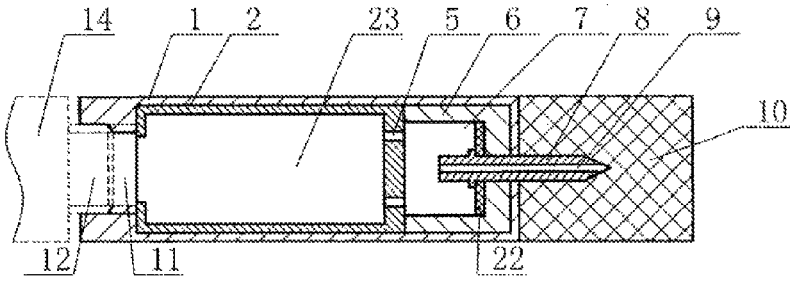
FIG. 4 is the structure diagram of the first embodiment of the smoking set of the electronic simulation cigarette in the present invention.

A first possible structure is to install a Fixation 6 at the connection end of suction nozzle 10 (FIG. 4) and shell 1 of the smoking set. On the fixation 6 (FIG. 4), a joint lever 8 (FIG. 4) is installed, through which the fixation 6 (FIG. 4) is linked to suction nozzle 10 (FIG. 4). The vent hole on the fixation 6 (FIG. 4) allows the air to enter suction nozzle 10 (FIG. 4) more easily. In shell 1 (FIG. 4), orifice plate 2 (FIG. 4) is set up having a through hole 5 on orifice plate 2. The suction nozzle 10 (FIG. 4) is a filter tip.

A second possible structure is to connect suction pipe 24 (FIG. 5) and shell 1 (FIG. 5) of the smoking set directly as shown in FIGS. 2 and 5. The suction pipe 24 (FIG. 5) can be made from plastic materials or other suitable materials. The orifice plate 2 is set up in shell 1 (FIG. 5) and the through hole 5 (FIG. 5) is opened on the orifice plate 2 (FIG. 5). A suction hole (13) is set up in the short joint lever 8 (FIG. 5), which is located inside of the end of the suction pipe (24); a smoking solution backflow cavity 7 (FIG. 5) is set up in the suction pipe 24 (FIG. 5).

In order to avoid sucking in the smoke solution after its backflow, smoke solution backflow cavity 7 (FIG. 4) is set up on fixation (6) (FIG. 4), a through hole 9 (FIG. 4) is set up on joint lever 8 (FIG. 4). One end of joint lever 8 (FIG. 4) is linked to suction nozzle 10, while the other end is inserted into the center of smoke solution backflow cavity 7 (FIG. 4). Therefore, the possible backflow of the smoke solution can be held up in smoke solution backflow cavity 7 (FIG. 4).

In order to further absorb the back-flowed smoke solution, absorption pad 22 (FIG. 4,5) has been installed at the inner wall of the smoke solution backflow cavity 7 (FIG. 4,5) and at the connecting pin of joint lever 8 (FIG. 4,5).

When the structure of directly connecting suction pipe 24 (FIG. 5) and shell 1 (FIG. 5) of the smoking set is adopted, the structure which can avoid sucking in the backflow of the smoke solution is: the suction hole 13 (FIG. 5) is set up in the short joint lever 8 (FIG. 5), which one end is at end of suction pipe 24 (FIG. 5) and the other end is inserted into the centre of smoke solution backflow cavity 7 (FIG. 5). Suction pipe 24 (FIG. 5) is communicated with suction hole 13 (FIG. 5) and hole 5 (FIG. 5) on orifice plate 2 (FIG. 5). The suction pipe 24 (FIG. 5) is press fitted into shell 1 (FIG. 5), in which orifice plate 2 is set up, and open through hole 5 on orifice plate 2.

Figure 6:
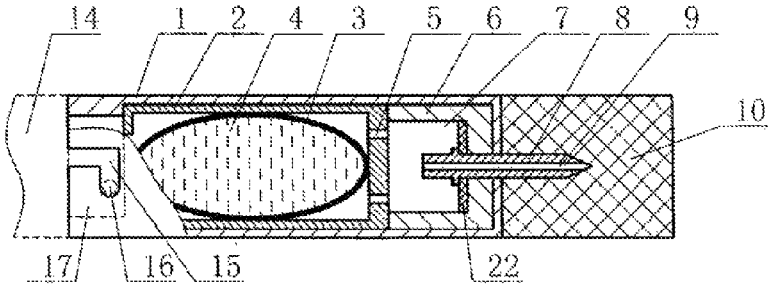
FIG. 6 is the structure diagram of the third embodiment of the smoking set of the electronic simulation cigarette in the present invention.
Figure 7:
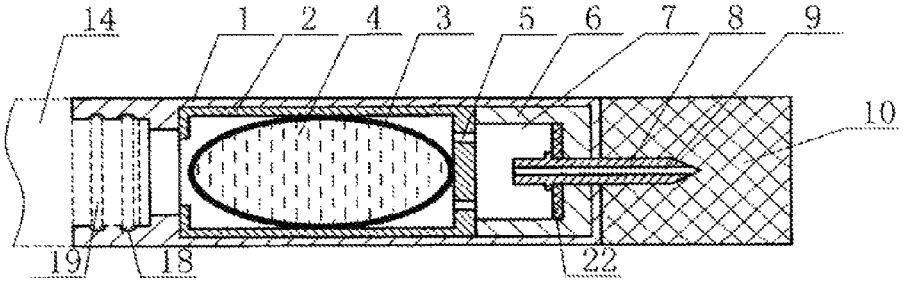
FIG. 7 is the structure diagram of the fourth embodiment of the smoking set of the electronic simulation cigarette in the present invention.
Figure 8:
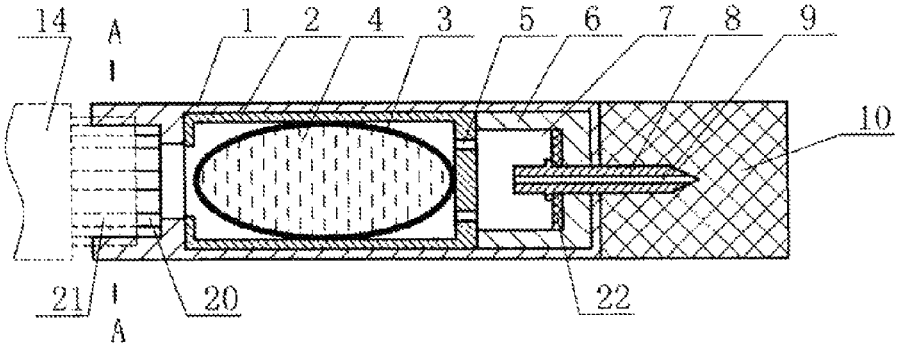
FIG. 8 is the structure diagram of the fifth embodiment of the smoking set of the electronic simulation cigarette in the present invention.
Figure 9:
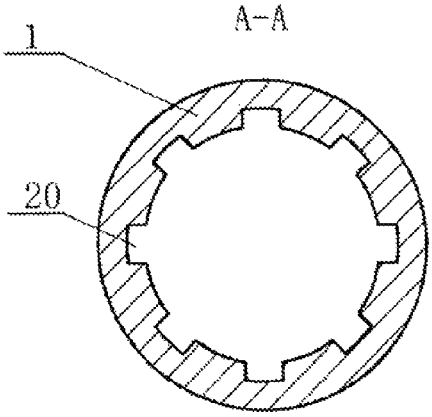
FIG. 9 is the enlarged structure diagram of A-A section in FIG. 5.

In the present invention, in order to co-use the smoking set with the atomization and spray device of the electronic simulation cigarette, the connection unit is designed. Various connection types are shown at the left edge of the view orientation in FIG. 6, FIG. 7 and FIG. 8. For example, it could be screw joint as shown in FIG. 1 and FIG. 2; the connection of the slot and the inserting pillar shown in FIG. 6 is to set up slot 15 at the left-handed side of the smoking set and set up inserting pillar 16 at the right side of the atomization and spray device in the electronic simulation cigarette, then insert inserting pillar 16 into slot 15 and turn with some angle to tightly integrate the smoking set and the atomization and spray device of the electronic simulation cigarette; what shows in FIG. 7 is the connection of the circumferential embossment and the circumferential groove, which means to set up groove 18 on the inside wall at the left end of the smoking set, set up embossment 19 at the peripheral region of the atomization and spray device of the electronic simulation cigarette. The smoking set and the atomization and spray device of the electronic simulation cigarette are tightly connected after the co-use of groove 19 and embossment 18; axial slot connection is shown in FIG. 8: set up axial slot 20 on the inside wall at the left end of the smoking set, set up inserting block 22 at the right end of the atomization and spray device in the electronic simulation cigarette and finally the atomization and spray device and the smoking set will be tightly combined after the co-use of inserting block 21 and axial slot 20. The connection unit of the smoking set and the atomization and spray device of the electronic simulation cigarette said in the present invention can be exchanged between the smoking set and the atomization and spray device which means the structures on the smoking set can also be set up on the atomization and spray device. Furthermore, the said connection unit of the smoking set and the atomization and spray device in the present invention is not limited among the structures in the present invention.

Figure 10:
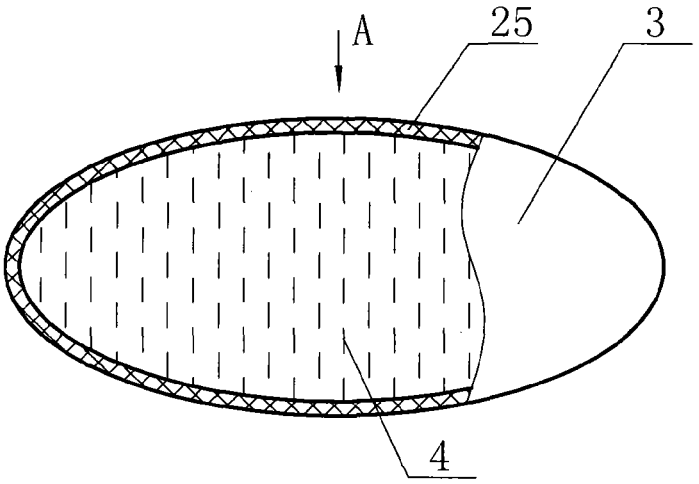
FIG. 10 is the structure diagram of the smoke solution capsule which is co-used with the electronic simulation cigarette in the present invention.
Figure 11:
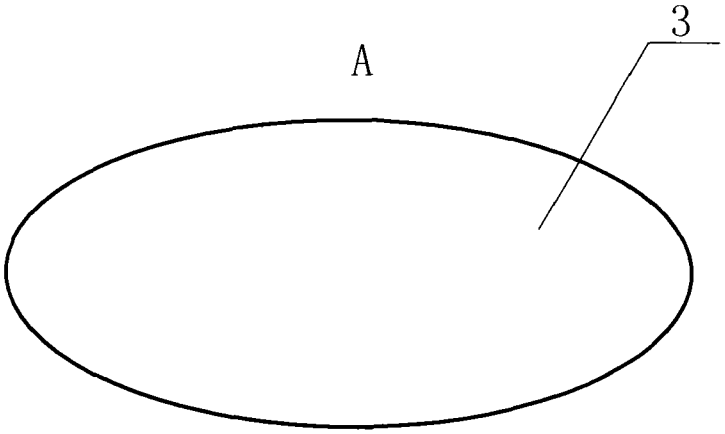
FIG. 11 is the vertical view structure diagram of FIG. 10.
Figure 12:
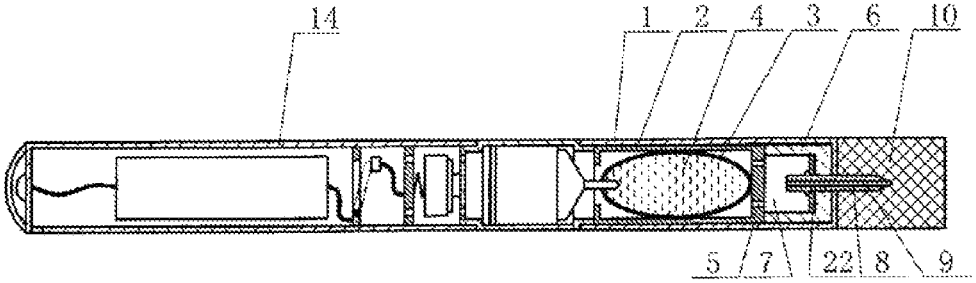
FIG. 12 is the active condition structure diagram of the co-using between the smoking set and the atomization and spray device of the electronic simulation cigarette in the present invention.

The other product said in the present invention is the smoke solution capsule or liquid container. Its structure is: Shell 25 (FIG. 10) is made by soft capsule material or a plastic container which are for medical use. The shape of shell 25 (FIG. 10) could be any regular or irregular geometry with smoke solution 4 (FIG. 10) in shell 25 (FIG. 10). The optimum scheme of the present invention is: shell 25 (FIG. 10) is of oval type. After study, this form is very convenient for storage, delivery; lay up in cavity 23 (FIG. 4), production, outflow of the smoke solution and so on.

Smoke solution 4 (FIG. 5-8) in shell 25 (FIG. 10) is the mixture of the Polyethylene glycol, the Propylene glycol, Glycerine, Water and the taste modifier. The mixture could be the polyethylene glycol 25-90 weight share, the propylene glycol 9-50 weight share, Glycerine 1-70 weight share, water 1-30 weight share and the taste modifier 0.3-52 weight share.

The said taste modifier's weight share raw material is constituted by one or more than two raw materials that followed: 2-acetylpyrazine, vanillin, 2,3,5-trimethylprazine, methyl cyclopentenolone, linalool, extracts of *Vanilla planifolia*, caprylolactone, Bulgarian Rose Otto, megastigmatrienone (Baosha aromatic tobacco essential oil), damascenone (fire-cured tobacco essential oil), purified water, menthol, fire-cured tobacco essential oil, fire-cured tobacco absolute oil, burley tobacco absolute oil, Turkey aromatic tobacco absolute oil and glycerin.

Raw materials which can be added in the mixture are measured by amount by weight: green tea extracts 2-10 weight share, caffeine 2-10 weight share, extracts of wolfberry 3-20 weight share or Viagra virility medication 1-5 weight share, nicotine 0.5-18 weight share and purified water 0.5-10 weight share.

11 and 12 from FIG. 4 to FIG. 12 are both connecting pins of the atomization and spray device, 14 is the atomization and spray device of the electronic simulation cigarette and 17 is also the connecting pin of the atomization and spray device.

What is claimed is:

1. An electronic simulation cigarette, comprising:

a shell;

an air inlet port set up at one end of the shell;

a power source installed in the shell;

an atomization and spray device installed in the shell;

a heater installed in the atomization and spray device and connected to the power source;

a capsule installed in the shell, the capsule filled with a smoke solution and connected with the atomization and spray device; and a capsule aspiration device installed at one end of the atomization and spray device and penetrating into the capsule, wherein:

the atomization and spray device comprises a liquid resistance plate, a liquid storage chamber, an atomizing chamber and a supporting base, the heater is installed in the atomizing chamber, the supporting base has a jet hole thereon, the capsule aspiration device comprises an aspiration needle tube, the aspiration needle tube comprising a stylet and configured to penetrate into the capsule, an infilling siphoning material is filled in the liquid storage chamber, the liquid storage chamber is connected with a fluid guide rack connected to the aspiration needle tube, the liquid resistance plate has a vent hole thereon, and the shell is divided into a plurality of sections comprising at least a first section containing the capsule and a second section containing the heater, the first section detachable from the second section to facilitate replacement of the capsule.

2. The electronic simulation cigarette according to claim 1, wherein:

a filter tip fixation is installed at one end of the shell and configured to be connected with a filter tip, a joint lever is installed on the filter tip fixation, the filter tip fixation is connected with the filter tip via the joint lever, a through hole is located at a middle location of the joint lever, and a cavity is set up on the filter tip fixation while the through hole is connected with the cavity.

3. The electronic simulation cigarette according to claim 1, further comprising a capsule fixation installed at a peripheral region of the capsule, wherein an outer end wall of the capsule fixation includes an air passage.

4. The electronic simulation cigarette according to claim 1, further comprising:

a switch-return spring;

a pneumatic transmission switch; and a pneumatic transmission switch contactor, wherein each of the switch-return spring, the pneumatic transmission switch and the pneumatic transmission switch contactor is installed in the shell, and wherein the pneumatic transmission switch contactor is connected with a support with the support connected with the heater through a junction block.

* * * * *